United States Patent [19]

Steinhart et al.

[11] Patent Number: 5,046,211

[45] Date of Patent: Sep. 10, 1991

[54] DEVICE FOR CLEANING VEHICLE PARTS, IN PARTICULAR GLASS PANES OF VEHICLES

[75] Inventors: Wilhelm Steinhart, Friedberg; Mohann Maischberger, Dinkelscherben; Thomas Biewald, Memmingen; Gerwin Berens, Augsburg, all of Fed. Rep. of Germany

[73] Assignee: Kuka Schweissan & Roboter GmbH, Augsburg, Fed. Rep. of Germany

[21] Appl. No.: 504,583

[22] Filed: Apr. 4, 1990

[30] Foreign Application Priority Data

Apr. 5, 1989 [DE] Fed. Rep. of Germany ..... 39110370

[51] Int. Cl.[5] ..... A47L 1/02

[52] U.S. Cl. ..... 15/102; 15/103; 15/21.1; 15/88.1; 15/88.2; 15/97.1; 134/32

[58] Field of Search ..... 15/102, 103, 21.1, 88.1, 15/88.2, 97.1

[56] References Cited

FOREIGN PATENT DOCUMENTS 0111206 6/1984 European Pat. Off. ..... 15/97.1
0176701 4/1986 European Pat. Off. .

*Primary Examiner*—Theodore Morris
*Assistant Examiner*—Zeinab El-Arini
*Attorney, Agent, or Firm*—McGlew & Tuttle

[57] ABSTRACT

The present invention pertains to a process and a device for cleaning parts, in particular glass panes (2) of vehicles to prepare them for subsequent treatment processes, such as application of adhesive, etc. The cleaning device (1) comprises a wiping element in the form of a cleaning band (10) which is moved relative to the part (2) to be treated. The cleaning band is guided in a loop (12) between two rolls (13 and 14) and is brought into contact with the part (2) to be treated, while the cleaning band (10) is wound off section by section and cyclically between or during the cleaning processes. To do so, an additional loop (44) is formed in the area of the loop (12) and fresh band material is wound off of the reserve roll (13). The loop (44) is subsequently eliminated and the used band material is fed to the used-material roll (14).

17 Claims, 6 Drawing Sheets

DEVICE FOR CLEANING VEHICLE PARTS, IN PARTICULAR GLASS PANES OF VEHICLES

FIELD AND BACKGROUND OF THE INVENTION

The present invention pertains to a process and a device for cleaning vehicle parts, in particular vehicle glass panes in preparation for subsequent treatment and/or installation processes. The cleaning device includes a wiping element and the wiping element and the vehicle part are moved relative to one another by means of a multiaxial manipulator or the like.

During installation by adhesion of glass panes in vehicle bodies, it is necessary to intensely clean the surfaces of the pane to which adhesive is to be applied prior to application of the adhesive. It is known in this connection from EP-A 0,111,206 and EP-A 0,176,701 that it is possible to use a cleaning device with a wiping element that is moved by an industrial robot relative to the glass pane of the vehicle. A cleaning fluid is applied by means of a spraying device, and this cleaning fluid is wiped off, together with the dirt particles, by the wiping element which subsequently arrives at the location. The wiping element, soaked full, is released at the end of the cleaning process and a new one is taken up. The wiping elements consist of small pieces of rag which can be used only once and are taken up with a grasping device, held during the wiping process, and subsequently released.

The use of individual pieces of rag has proved to be disadvantageous in practice. The pieces of rag often cling to the grasping device during the opening of the grasping device. On the other hand, additional movement processes are necessary for grasping and releasing the pieces of rag, and they prolong the cycle time. It may be necessary to replace the pieces of rag several times in the case of relatively large glass panes and heavy soiling.

In addition, when pieces of rag are released, additional measures are required for safely removing them from the grasping device.

SUMMARY AND OBJECTS OF THE INVENTION

Therefore, the task of the present invention is to provide a process and a device for cleaning, which makes it possible to operate more rapidly, economically and safely and permits rapid and reliable removal of the wiping element.

This task is accomplished according to the present invention by providing a process by which the wiping element includes a plurality of wiping surfaces wherein the surfaces are brought into contact with the vehicle part, one after another. The wiping surfaces are changed cyclically by feeding the wiping element forward between or during the cleaning processes.

According to the invention, the device for automatically cleaning vehicle parts, in particular glass panes of vehicles, comprises a multiaxial manipulator or the like for moving the cleaning device relative to the vehicle part. The cleaning device includes a wiping element with a plurality of wiping surfaces and includes feed drive means for feeding the wiping element forward section by section in a cyclical manner.

The process according to the present invention and the corresponding cleaning device have the advantage that the wiping element can be used for a rather long time and need not be replaced after each cleaning process. The present invention also permits more rapid replacement of the wiping surface than is possible according to the state of the art. Additional movements of the complete cleaning device, which require time, energy and control, are no longer necessary due to the internal replacement of the used wiping surfaces. The replacement of the wiping surface can be carried out during the change from one vehicle part to the next, during cleaning in the corner zones of the vehicle part during reorientation of the cleaning device, or even during the wiping process.

The process and the corresponding device can be used to clean any vehicle parts and can be expanded to any fields of application in which a relative movement between the cleaning device and the vehicle part is involved. Multiaxial manipulators, for example, industrial robots, are provided as the device for mutually guiding and moving the cleaning device and the vehicle part. The preferred field of application and the particular suitability lie within the automatic cleaning of vehicle parts, especially vehicle glass panes. The panes are prepared for subsequent treatment processes. In the embodiment described, these consist of the application of a primer and an adhesive as well as and the subsequent installation of the pane. The treatment processes may also be, in principle, of a different nature.

Compared with the state of the art, the present invention permits kinematic reversal of the relative movement between the cleaning device and the vehicle part, especially a vehicle glass pane, by an industrial robot moving the pane against the cleaning device which is relatively stationary but is mounted so that it is able to perform an evading movement. The industrial robot is thus able—in one operation—to remove a pane from a stack, move it past the cleaning device and the adhesive application device and subsequently install it in the vehicle body. This is less expensive, simpler, and more rapid than according to the state of the art which provides for moving the cleaning device by the robot. As an alternative, the cleaning device according to the present invention can also be moved according to the prior-art method.

The wiping element with the plurality of wiping surfaces may have different designs. For example, a felt disk rotated cyclically or section by section may be used for this purpose. The wiping surfaces may be formed by disk sections on the circumference or on the end faces. An additional displacing movement of the disk axis makes it possible to use a larger disk surface and to considerably increase the number of wiping surfaces available.

A wiping element in the form of a cleaning band offers particular advantages. The useful surface is particularly large, which leads to long service life. Only a relatively simple kinematic system and similarly unsophisticated feed drive are required for feeding. In addition, the rolls can be replaced rapidly and simply.

It is recommended for economic reasons that the wiping element, especially one in the form of a cleaning band, be always fed by equal sections. The sections may be equal to or only slightly larger than the used wiping surface. This can be achieved in a simple manner in the case of the cleaning belt with a feed drive which acts on the loop and increases the loop length by forming an additional loop. Regardless of the roll thickness, equal amounts of band material are always fed from the reserve roll. The additional loop is subsequently eliminated by rotating the used-material roll. This makes it possible to use a particularly simple feed drive. The lifting movement can always remain the same regardless of the steadily changing thickness of the two rolls.

In the embodiment shown, the feed drive consists of a tensioning cylinder which acts on the loop and a servo controlled winding cylinder which moves the used-material roll. The fact that the tensioning cylinder acts on the lateral loop strand leading to the used-material roll has the advantage that band feed is possible without lifting the cleaning device from the vehicle part. This is useful especially if removal of the used wiping surface is desirable during the wiping process.

In addition to this design of the feed drive, clutches for controlled rotary movement are provided on the winding drums. The winding drums are alternatingly blocked and released so that the cleaning band is fed by exactly the desired length and in the predetermined direction. The feed and loop length can be changed by adjusting the stroke of the tensioning cylinder. The clutches may differ, e.g., they may be designed as spring-loaded friction clutches with locking pawl or the like.

In a modified version of the embodiments, the feed drive may also have a different design. One possibility is to use controllable winding drives which drive the winding drums as a function of the winding thickness. For example, electric stepping motors are suitable for use as winding drives. According to another variation, a friction wheel drive is provided, which acts on the cleaning band in the zone of the loop and moves it by a defined length.

In the preferred embodiment, the band reserve and the used material are wound up in rolls. In conjunction with the drum design according to the present invention, this permits rapid replacement of the rolls and secure holding and guiding of the band material. As an alternative, the band reserve and the used-up material may also be accommodated differently, e.g., they may be laid out in meander-shaped loops and in a container.

The cleaning device according to the present invention is mounted movably and elastically in its holding device. This makes it possible, on one hand, to avoid contact with obstacles or unevenesses on the vehicle part, and, on the other hand, to set the force with which the cleaning band is pressed against the vehicle part. To avoid contact with larger obstacles, a clamping device is provided, which brings about rigid connection between the cleaning device and its holding device, so that relative lifting movements between the cleaning device and the vehicle part can be performed.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DETAILED DESCRIPTION OF THE PREFERRED EMBODIMENT

Figure 1:
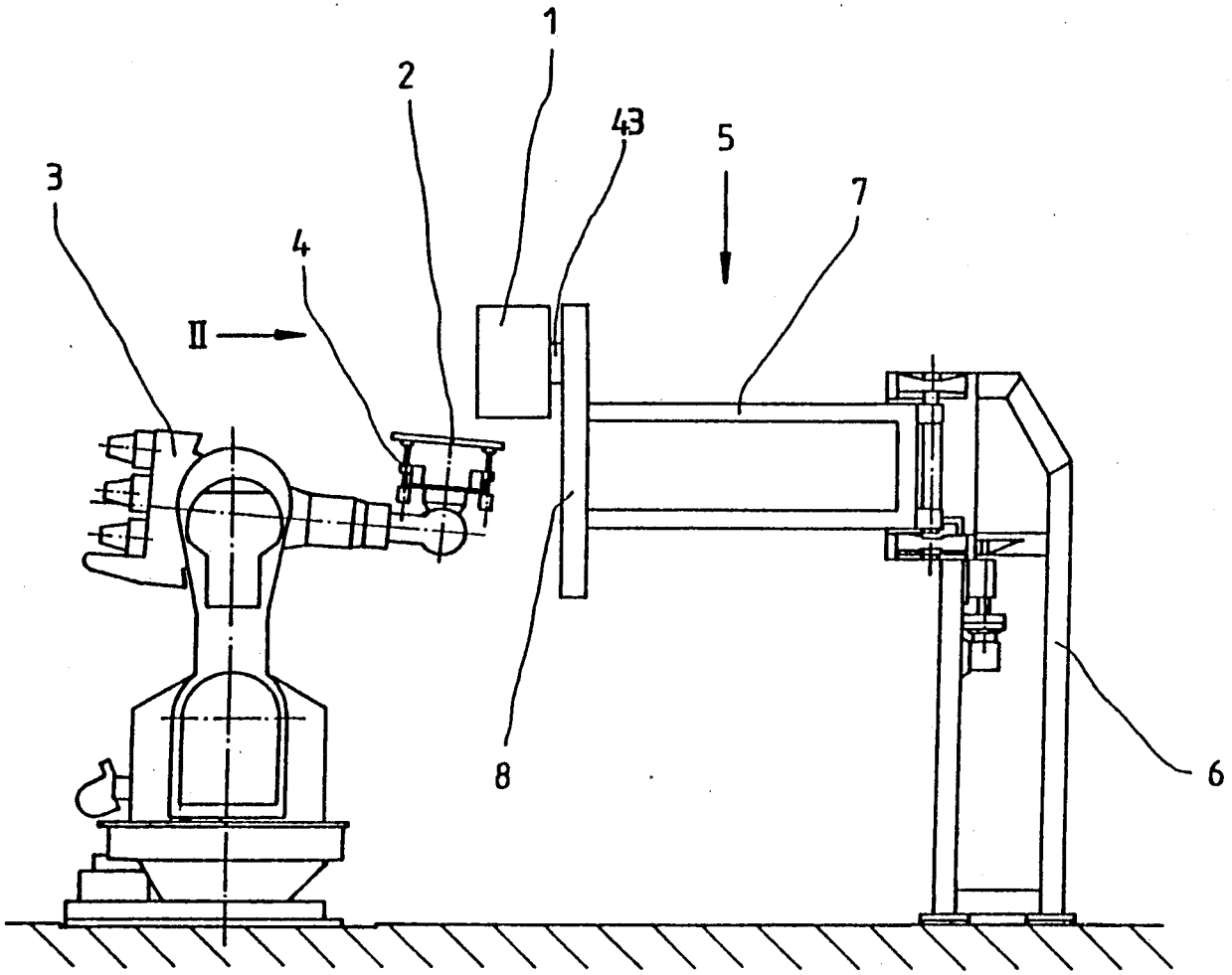
FIG. 1 is a side view of a processing station with a relatively stationarily mounted cleaning device and a robot-guided glass pane of a vehicle.

FIG. 1 shows a processing station for preparing glass panes 2 of vehicles for subsequent installation in vehicle bodies. The vehicle glass pane 2 or window is fastened by a grasping device 4 on the hand of a multiaxial manipulator 3 and is moved and guided by the latter along a preprogrammed path. The manipulator is preferably designed as an industrial robot 3 . In the situation shown, it moves the vehicle glass pane 2, previously removed from a stack of panes, along a cleaning device 1. This removes dirt, grease, and other contaminants from the edges of the pane in order to ensure reliable adhesion of a strand of adhesive applied in a subsequent station. At the end of the operation, the industrial robot 3 inserts the pane 2 exactly into the cut-out provided for it in the body. It subsequently picks up another vehicle glass pane and the above-described process starts anew.

During the cleaning process, the vehicle glass pane 2 and the complete cleaning device 1 are moved relative to one another. In the case shown, the cleaning device 1 is mounted relatively stationarily on a holding device 5. It is also possible to select a different kinematic association by moving the cleaning device 1 relative to a stationary vehicle glass pane 2. According to yet another modification, it is also possible to move both parts at the same time.

In FIG. 1, the holding device 5 consists of a stationary frame 6 and a swivel arm 7 which is mounted on the frame 6 rotatably around a vertical axis and whose end carries a guide rail 8 to which a slide carriage 43 carrying the cleaning device 1 is attached adjustably in height. The cleaning device 1 in turn is mounted on the slide carriage 43 adjustably in height and elastically in itself. The further details will become apparent from FIG. 3 and the description below.

Figure 2:
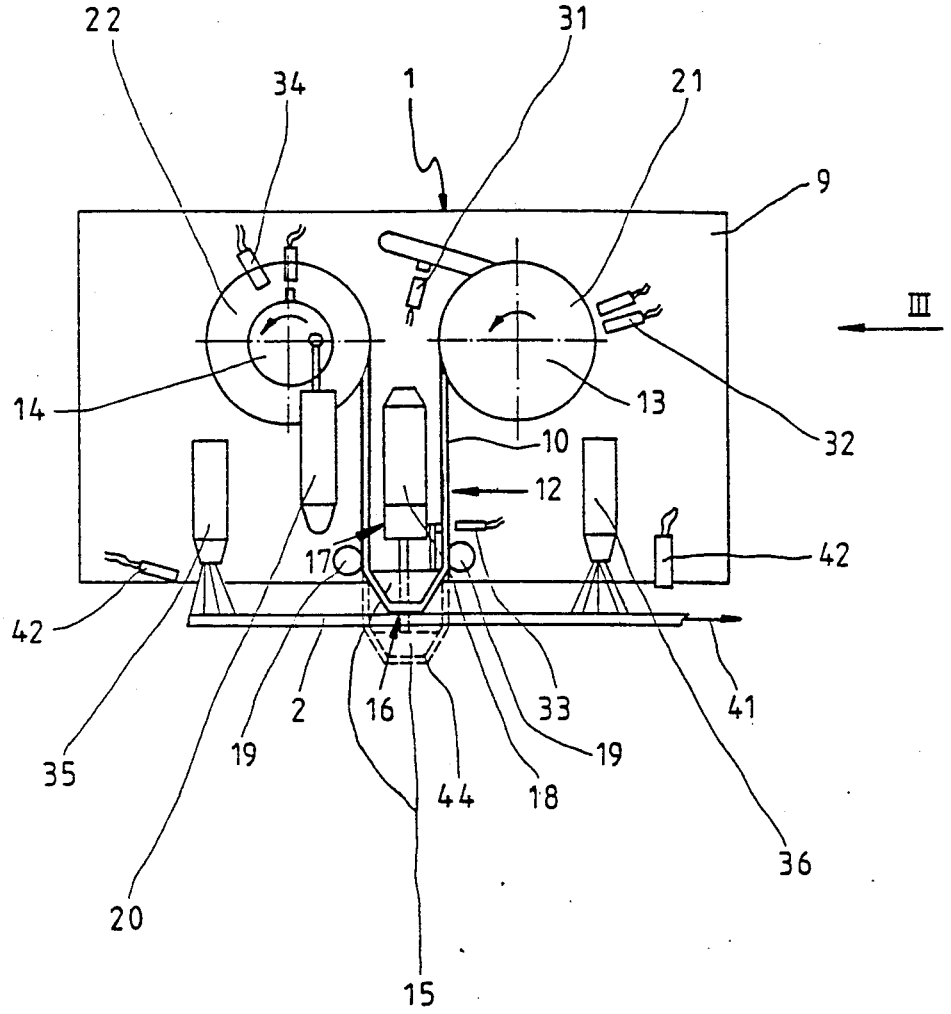
FIG. 2 is a front view of the cleaning device taken in the direction of arrow II in FIG. 1.
Figure 3:
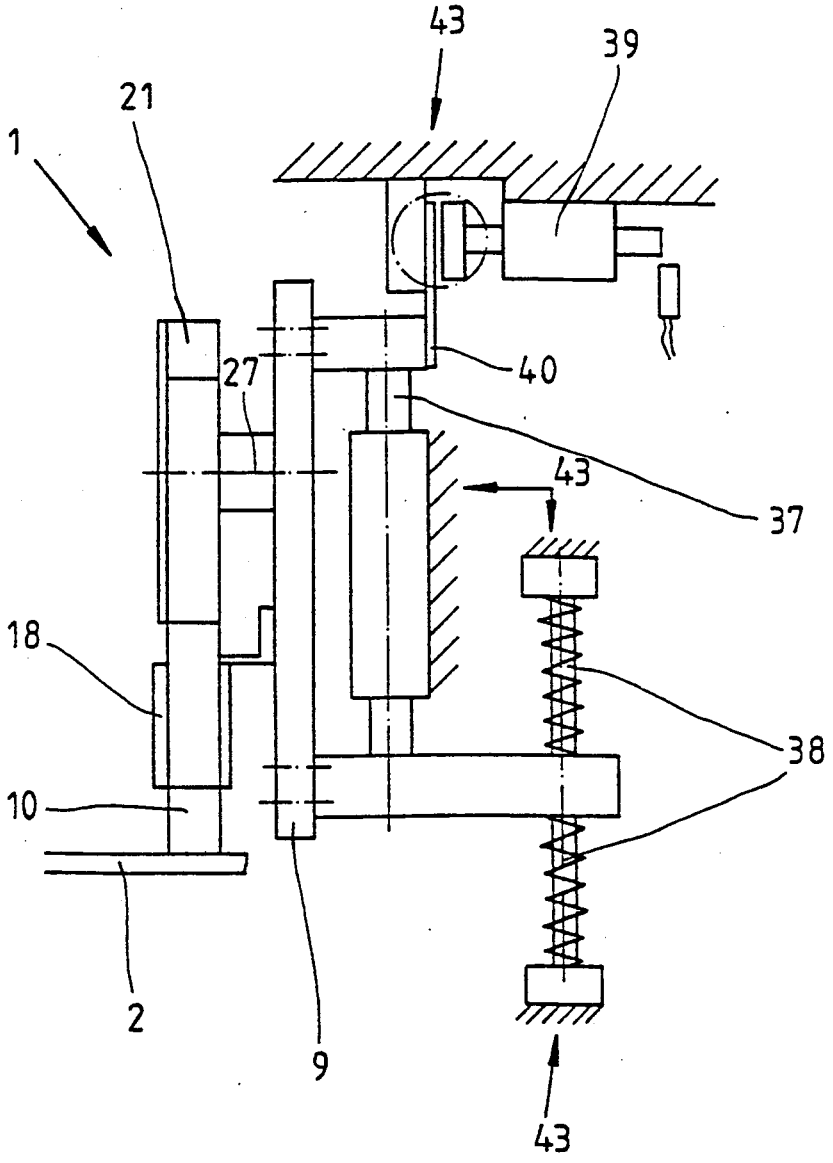
FIG. 3 is a side view of the cleaning device along arrow III in FIG. 2.

FIG. 2 shows the front view of the cleaning device 1 and FIG. 3 shows the corresponding side view. The cleaning device 1 consists of a cleaning band 10 made of felt or another suitable material which is guided between two rolls 13 and 14 in a downwardly directed loop 12, and with a wiping surface 16, it is in contact at the lower end of the loop with the vehicle glass pane 2. The cleaning device also comprises two winding drums 21 and 22, on which the band rolls 13 and 14 are placed, as well as a feed drive 17 for the cyclic and stepwise feed of the cleaning band 10. By winding off the cleaning band 10, a used and soiled wiping surface 16 is fed forward and replaced with a new band section. Together with the feed drive 17, the winding drums 21 and 22, which are rotatable around horizontal axes 27, are fastened on a base plate 9.

For the field of application shown, namely, the cleaning and preparation of a vehicle glass pane for the subsequent adhesive coating and installation, the cleaning device 1 also comprises a spraying device 35 for a cleaning fluid and an application device 36 for the primer. The vehicle glass pane 2 is moved past the cleaning device 1 in the direction of feed 41 indicated by an arrow. The spraying device 35 is located in the direction of feed 41 in front of the loop 12, while the application device 36 is arranged behind the loop 12. The cleaning fluid, sprayed as a narrow strip on the edge of the glass pane, is wiped off and absorbed with the wiping surface 16 of the cleaning band 10. This surface is subsequently coated with the primer in the same process step or in a separate process step and prepared for the strand of adhesive. The functions of the spraying device 35 and the application device 36 are monitored and controlled by sensors 42.

In the embodiment shown, the reserve roll 13 containing the fresh band material is arranged behind the loop 12 in the direction of feed 41, whereas the used-material roll 14 is located in front of it. At the lower end of the loop 12, the cleaning band 10 is led over a pressing piece 15 with truncated cone-shaped cross section. In its horizontal area, the wiping surface 16 is pressed against the vehicle glass pane 2.

Figure 4:
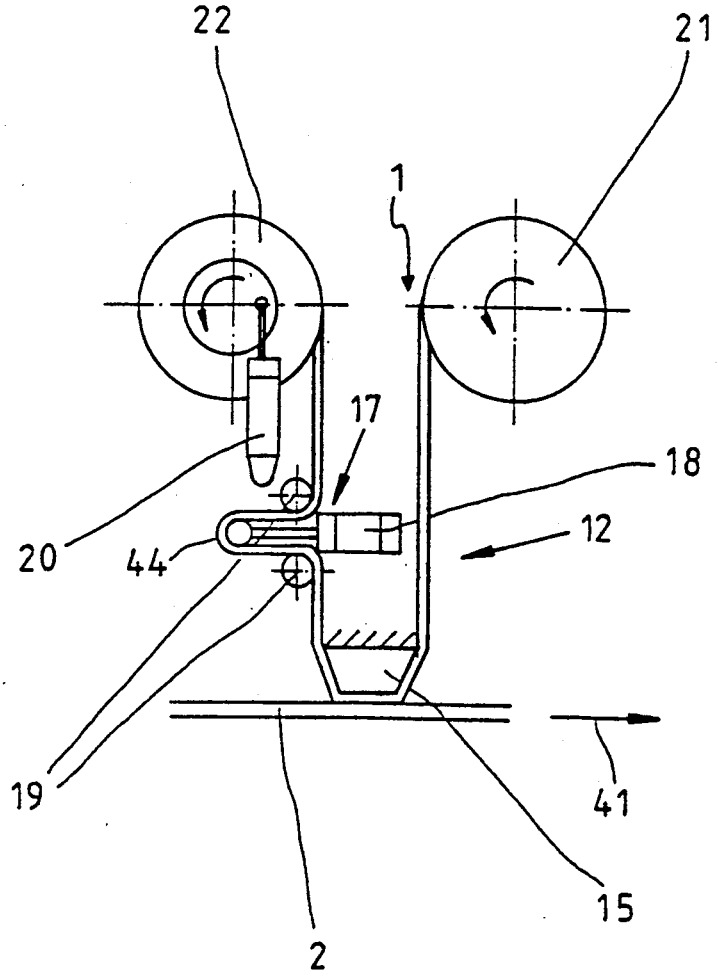
FIG. 4 is a front view of the cleaning device as a variation of FIG. 2; and, FIGS. 5–7 are different views showing details of a winding drum.

FIGS. 2 and 4 show two different embodiments of the feed drive 17. In both cases, the feed drive 17 consists of a tensioning cylinder 18 and a winding cylinder 20, which are designed as pneumatic and/or hydraulic cylinders and have a servo control. The tensioning cylinder 18 acts on the cleaning band 10 in the zone of the loop. The winding cylinder 20 drives the winding drum 22 in the counterclockwise direction. Via a freewheeling mechanism or another device, the winding cylinder 20 acts on the winding drum 22 such that it rotates the winding drum 22 during feed and it does not rotate the winding drum during the reverse stroke.

Both winding drums 21 and 22 have clutches for alternating and controlled rotary movement. The clutches permit only counterclockwise rotary movement of both winding drums 21 and 22. In addition, they prevent more band material than is needed from being delivered during the winding up of the used material on the roll 14.

The length over which the band is fed is determined by the tensioning cylinder 18 which acts on the loop 12 in both embodiments and forms an additional loop 44 when its piston extends, after which this [additional loop] is again eliminated. The length of the loop 44 approximately corresponds to the length of the wiping surface 16 and is always the same, regardless of the roll sizes. It may be varied by changing the length of stroke of the piston and/or the radius of deflection.

FIG. 2 shows the tensioning cylinder 18 in the middle of the loop 12, arranged in its longitudinal direction. Tensioning rollers 19 are arranged on both sides of the loop 12, approximately at the level of the resting position of the pressing piece 15. The piston, which can be extended in the downward direction, carries at its end the pressing piece 15. When the tensioning cylinder 18 is activated, it pulls out the additional loop 44 in the downward direction (shown in broken line) during its sinking movement. The tensioning rollers 19 support the loop formation and provide for constant loop shape.

Simultaneously with the tensioning cylinder 18, the piston of the winding cylinder 20 moves back, and the engagement with the winding drum 22 is interrupted by the freewheeling mechanism. The winding roller 22 itself is locked by the clutch to prevent it from turning back. Therefore, band material can be pulled only from the reserve roll 14. The winding drum 21 now rotates against the force of a spring, whose restoring force is weaker than the feed force of the tensioning cylinder 18.

The piston of the tensioning cylinder 18 is subsequently retracted; at the same time, the piston of the winding cylinder 20 is extended. The winding roller 22 then rotates, and the band material contained in the loop 44 is wound up by exactly the length of band which is released during the reverse stroke of the tensioning cylinder 18. The cleaning band 10 always remains taut during this process. The feed force of the winding cylinder 20 is now weaker than the spring restoring force on the winding drum 21, so that the latter is locked and only the used band material is fed during the winding movement.

In the embodiment according to FIG. 4, the tensioning cylinder 18 is arranged within the loop 12, but in a transverse direction in this case. With its piston and a rotatable deflecting roller fastened to it, it acts on the lateral loop strand leading to the used-material roll 22 behind the now stationary pressing piece 15. On the other sides of the loop strand two tensioning rolls 19 are arranged one on top of another on both sides of the piston's path of movement. During the extension of the piston, the additional loop 44 is pulled out to the side between the two tensioning rollers 19. The winding drums 21 and 22 and the winding cylinder 20 now operate in the above-described manner. Due to the lateral loop formation and the stationary pressing piece 15, the embodiment according to FIG. 4 permits the wiping surface to be replaced while the cleaning band 10 is in contact with the glass pane 2.

As is illustrated in FIG. 2, various devices for monitoring the individual devices are provided. The monitoring device 31 serves to control the thickness of the reserve roll 13 and consists of a swivel arm, which comes into contact with the roll 13 and a switch contact. If the roll thickness exceeds a predetermined value, the swivel arm touches the switch contact and generates a warning signal.

The monitoring device 32 serves to control the band feed. It is associated with the winding drum 21 and consists of two sensors which scan a row of teeth on the circumference of the drum without contact. The cleaning band 10 is fed only when the winding drum 21 also rotates, during the feed of the tensioning cylinder 18, and this is reported by the sensors; otherwise, the band is broken. A similar monitoring device 34 with one or two sensors is also located at the winding drum 22 and serves to control the winding-up movement and the function of the winding cylinder 20. The tensioning cylinder 18 also has a monitoring device 33 for position and drive control.

FIG. 3 shows the side view of other parts of the cleaning device 1. As was described in the introduction, the band-guiding parts are mounted on a base plate 9. This in turn is guided accurately in the vertical direction via a guide 37 on the slide carriage 43 of the holding device 5. For clarity's sake, only parts of the slide carriage 43 are shown. The direction of guiding is determined by the direction of pressure between the glass pane and the cleaning band 10. The base plate 9 also has a flange extending horizontally in the rearward direction, on which two vertical balancing springs 38 act on both sides and support the slide carriage 43, providing for an elastic support for it. The pressing pressure of the cleaning band 10 on the vehicle glass pane 2 is also adjusted by means of the balancing springs 38. The base plate 9 is thus able to avoid contact with unevennesses that may be present on the surface of the glass pane and yield elastically in the upward and downward direction.

In the case of major unevennesses on the surface of the glass pane or another vehicle part 2 to be cleaned, evading movement can be brought about by a relative lifting movement between the vehicle part 2 and the cleaning device 1 or its holding device 5. A clamping device 39, which temporarily establishes a rigid connection between the holding device 5 and the cleaning device 1 on activation, is provided for this purpose. The clamping device 39 consists of a pneumatic and/or hydraulic cylinder, which is attached to the slide carriage 43 and carries a clamping piece at the end of the piston rod. A vertical flange 40, which is clamped and held securely between the clamping piece and a stop part on activation of the cylinder, is rigidly connected to the base plate 9. The balancing springs 38 are also blocked as a result, so that the base plate 9 is also forced to move during lifting of the holding device 5 and is unable to follow the lowering movement of the vehicle part 2. A monitoring device with a sensor which controls the position of the piston extending in the rearward direction from the cylinder is provided for automating the plant.

Figure 5:
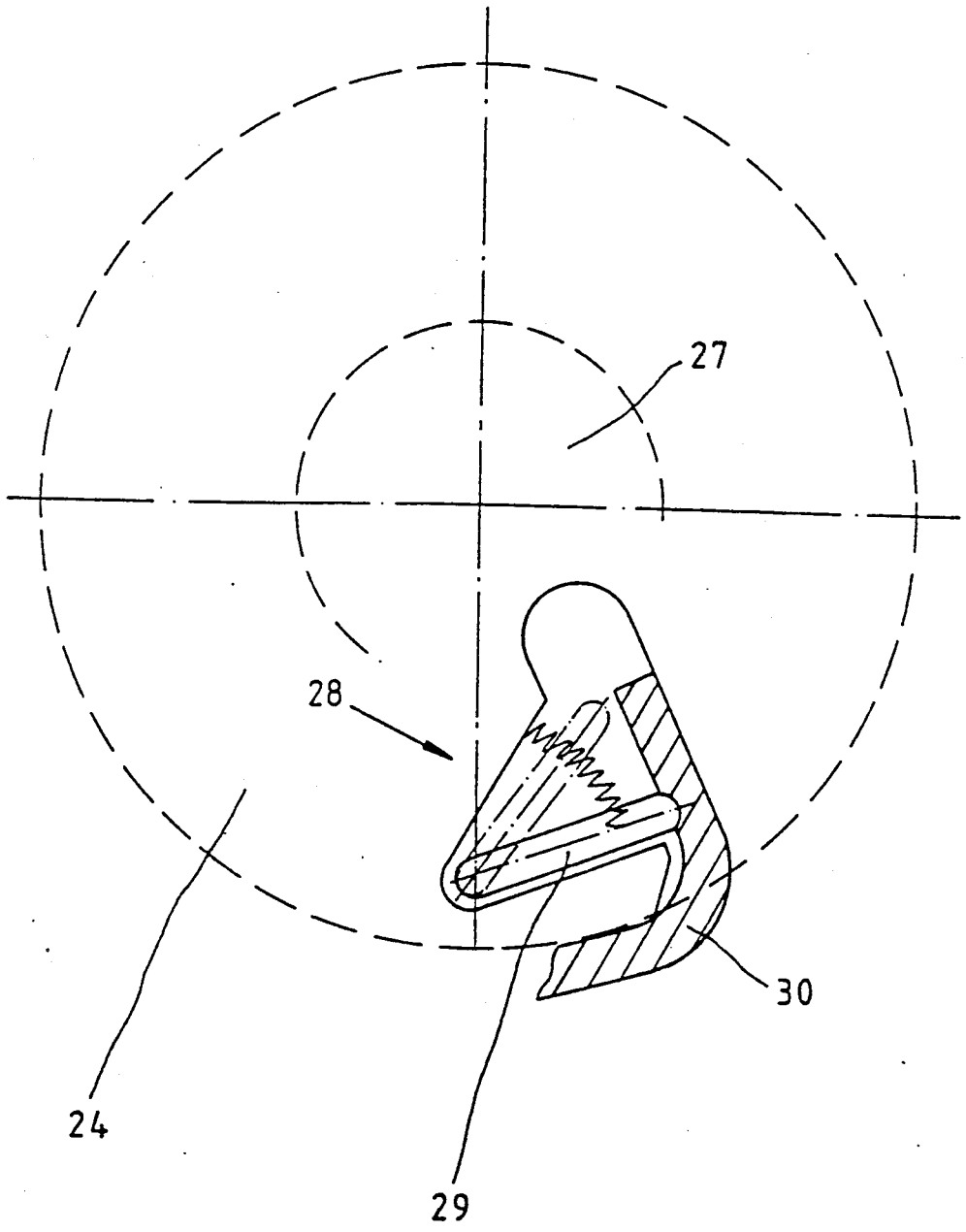
Figure 7:
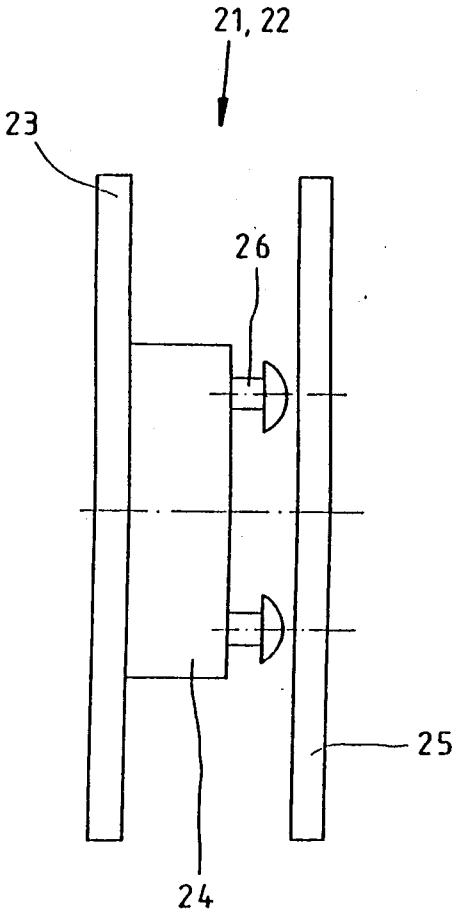
Figure 6:
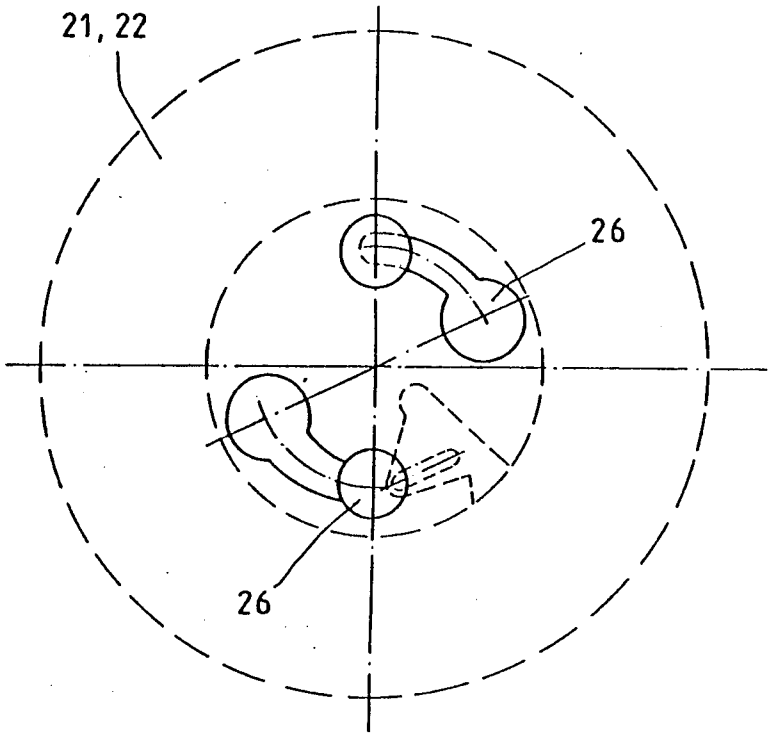

FIGS. 5 through 7 show details of the winding drums 21 and 22. FIGS. 5 and 6 show the design of the winding drums in a front view, while FIG. 7 shows a side view of FIG. 6. In the preferred embodiment, the felt band 10 is rolled into coreless rolls with a free inner band end 30. The winding drums 21 and 22 each have a disk-shaped body 23 with a roll core 24. A clamping device 28 for the band end 30 is accommodated in the roll cores 24. The clamping device consists of a radial slot in which a spring-loaded clamp strap 29 is pivotably mounted. When the band end 30 is pushed in, the clamp strap 29 yields against the spring force and then again comes into contact with the band end 30. It now clamps it against the slotted wall and is supported in the downward direction on a projection of the wall. The band end 30 is no longer able to be pulled out of the slot against the clamping effect of the strap 29.

The reserve roll 13 is placed over the roll core 24 of the winding drum 21 and fixed with its inner band end 30 in the clamping device 28. The cleaning band 10 is subsequently made into the required loop and its other end is also attached to the roll core 24 of the winding drum 22. The roll cores 24 are subsequently covered by roll covers 25 reaching over them for fixing the rolls 13 and 14 in the axial direction. The connection is ensured by a bayonet catch 26.

While specific embodiments of the invention have been shown and described in detail to illustrate the application of the principles of the invention, it will be understood that the invention may be embodied otherwise without departing from such principles.

What is claimed is:

1. A device for automatically cleaning vehicle parts, in particular glass panes of vehicles, for preparing vehicle parts for subsequent treatment and/or installation processes comprising: a multiaxial manipulator including means for holding a vehicle part; a cleaning device including a wiping element having a plurality of wiping surfaces provided one after another and means for cyclically feeding the wiping element forward to sequentially position one of said plurality of wiping surfaces at a cleaning location; and, means for moving said vehicle part held by said multiaxial manipulator and said cleaning device relative to one another as said vehicle part is in contact with said cleaning zone of said wiping element.

2. A device according to claim 1, wherein said vehicle part is held and moved by said manipulator, said cleaning device being mounted on a holding device and including resilient means for moving said cleaning device under force of said vehicle part and said multiaxial manipulator.

3. A device according to claim 1, wherein said wiping element is formed as a cleaning band fed from a fresh band material roll to a used-material roll in a loop about a pressing element, and a feed drive associated with said cleaning device for feeding said cleaning band between said fresh band material roll and said used material roll.

4. A device according to claim 3, wherein said feed drive includes a tensioning cylinder ranged in an area of said loop, said tensioning cylinder forming an additional loop; a winding cylinder acting on said used material roll for advancing said used-material roll and simultaneously eliminating said additional loop, each of said used-material roll and said fresh band material roll having clutches for controlled rotary movement.

5. A device according to claim 4, wherein each of said winding cylinder and said tensioning cylinder have a common control for simultaneous and opposite movement of pistons associated with said cylinders.

6. A device according to claim 4, wherein said winding cylinder acts on a winding drum via a free wheeling mechanism, said winding drum being connected to said used-material roll.

7. A device according to claim 4 wherein said tensioning cylinder is arranged within said loop extending in a longitudinal direction with respect to said loop, said tensioning cylinder carrying a pressing piece at its moveable end, for engagement with said band.

8. A device according to claim 4, wherein said tensioning cylinder acts on a strand of said loop leading to said used material roll, a location down stream of a pressing piece associated with said tensioning cylinder thereby forming a transversely directed loop in said cleaning band.

9. A device according to claim 8, wherein said tensioning cylinder is arranged within said loop.

10. A device according to claim 4, further comprising tensioning rollers for defining said loop, said tensioning rollers being arranged on each side of a feed path associated with said tensioning cylinder.

11. A device according to claim 3, wherein said feed drive includes controlled winding drives.

12. A device according to claim 3, further comprising monitoring means for controlling said band feed and controlling the reversal of said band, said monitoring means including devices associated with said winding drums and devices associated with said feed drive.

13. A device according to claim 6, wherein said winding drum includes a rotatably mounted body with a roll core for receiving a roll and a roll cover which is detachably mounted on said roll core via a bayonet catch.

14. A device according to claim 13, further comprising a clamping device for fixing a band end, said clamping device being positioned inside a roll core of each of said rolls.

15. A device according to claim 6, wherein said winding drums and said feed drive are mounted on a base plate, said base plate being mounted and guided for avoiding contact with said vehicle part.

16. A device according to claim 15, wherein a controllable control device is provided for temporarily fixing the position of said base plate.

17. A device according to claim 1, further comprising a spraying device for spraying a cleaning fluid, said spraying device being positioned in front of said loop upstream of the cleaning location with respect to the direction of feed of the vehicle glass and an application device for applying primer to the vehicle glass, said application device being located downstream of said cleaning location with respect to the direction of feed of said vehicle glass.

* * * * *